US006093259A

United States Patent [19]

Watanabe et al.

[11] Patent Number: 6,093,259

[45] Date of Patent: Jul. 25, 2000

[54] COLOR DEVELOPMENT METHOD OF METALLIC TITANIUM AND BLACK AND COLORED TITANIUM MANUFACTURED BY THIS METHOD

[75] Inventors: Munetoshi Watanabe, Suita; Tsuyoshi Sakaguchi, Amagasaki, both of Japan

[73] Assignee: Sumitomo Sitix Corporation, Amagasaki, Japan

[21] Appl. No.: 08/952,513

[22] PCT Filed: Mar. 13, 1997

[86] PCT No.: PCT/JP97/00798

§ 371 Date: Nov. 28, 1997

§ 102(e) Date: Nov. 28, 1997

[87] PCT Pub. No.: WO97/36019

PCT Pub. Date: Oct. 2, 1997

[30] Foreign Application Priority Data

Mar. 27, 1996 [JP] Japan ..... 8-99279
Mar. 27, 1996 [JP] Japan ..... 8-99280

[51] Int. Cl.[7] ..... C23C 8/24

[52] U.S. Cl. ..... 148/217; 148/237; 148/269; 148/277; 148/281; 428/472.1

[58] Field of Search ..... 148/269, 421, 148/217, 237, 281, 277; 428/65.3, 472.1

[56] References Cited

U.S. PATENT DOCUMENTS

| | | | |
|---|---|---|---|
| 2,864,732 | 12/1958 | Miller et al. | 428/472 |
| 2,934,480 | 4/1960 | Slomin | 205/152 |
| 3,687,741 | 8/1972 | Kendall . | |
| 4,394,224 | 7/1983 | Mahoon et al. | 205/322 |
| 5,074,972 | 12/1991 | Matz | 205/322 |
| 5,316,594 | 5/1994 | Kemp | 148/281 |
| 5,514,908 | 5/1996 | Liao et al. | 257/751 |

FOREIGN PATENT DOCUMENTS

| | | | |
|---|---|---|---|
| 48-95863 | 12/1973 | Japan . | |
| 62-10299 | 1/1987 | Japan . | |
| 1-306548 | 12/1989 | Japan . | |
| 3-140452 | 6/1991 | Japan . | |
| WO95/09932 | 4/1995 | WIPO | 148/421 |

*Primary Examiner*—Prince Willis
*Assistant Examiner*—Andrew L. Oltmans
*Attorney, Agent, or Firm*—Oblon, Spivak, McClelland, Maier & Neustadt, P.C.

[57] ABSTRACT

This invention provides color development methods of metallic titanium used for manufacture of black titanium or titanium tinted in other chromatic colors. In one method, metallic titanium is treated with an alkali solution. It enables colored titanium rich in color variation with high efficiency, irrespective of the material configuration. The brightness of black is further reduced by conducting a nitriding process, after this process. In another method, the metallic titanium is oxidized after forming the titanium nitride film on its surface by nitriding it. Black titanium is produced with low brightness. In this way, colored titanium with various tones is produced. Moreover, the close adherence of the film with colors developed thereon is enhanced.

11 Claims, 2 Drawing Sheets

COLOR DEVELOPMENT METHOD OF METALLIC TITANIUM AND BLACK AND COLORED TITANIUM MANUFACTURED BY THIS METHOD

TECHNICAL FIELD

The present invention relates to a color development method of metallic titanium used for manufacturing black or colored titanum tinted in chromatic colors of various tones, and also the black and colored titanium manufactured by this method. It should be noted that the titanium tinted in chromatic colors is differenciated from the black titanium by calling them colored titanium.

BACKGROUND TECHNIQUES

Black or various other chromatic colors are developed on a titanium surface by varying the thickness of its oxide film coating the surface of metallic titanium or by forming its nitride film on its surface. For example, powdery metallic titanium which has been subjected to such a color development treatment is in use for pigments for coating and printing, colorants for fibers and ornaments, cosmetic and sintering materials and so on.

References available regarding blackening process of metallic titanium include: Method for Forming Black Coating on Titanium Surface by Dipping Metallic Titanium in Dilute Aqeous Solution of Fluoric Acid (Japanese Patent No. 1190252), Method for Blackening Copper Deposited on Titanium Surface (Gazette: Patent Publication No. Sho 58-23469) and Two Step Process Using Sulfuric Acid and Fluoric Acid (Proceedings: The 77-th Metal Surface Technology Association Symposium, p. 184), etc.

As regards color development methods for developing colors other than black, there are known gas phase process of forming oxide or nitride film of titanium on its surface by oxidation or nitration reaction in gases, anodic oxidation process of forming its oxide film on the titanium surface by energizing it in an aqueous solution with the metallic titanium as an anode, and the chemical oxidation process of forming its oxide film on the titanium surface by heating the metallic titanium in an inorganic acid.

Of these color development methods, the blackening process involves such problems as stripping of the black coating or the requirement of applying a heat treatment for reduction of brightness. Color development methods for developing colors other than black respectively involve following problems:

The gas phase process comprises a method of heating metallic titanium in an oxygen or nitrogen atmosphere, using an electric furnace etc. Since the titanium surface is tinted by the action of the interference of light from the oxide or nitride film grown on the titanium surface by the heating, the tone may be altered by the thickness of the film. This method is advantageous in that colors may be developed, irrespective of the configuration of material, e.g. lumpy, spongy, or powdery (spherical, scaly) or other shapes, but contrarily it has a drawback of scanty color variations. For example, when the oxide film is formed by the gas phase process, the bluey and browny color ranges are relatively wide, but the reddish and greenish ranges are narrow, and the pinky and greeny colors are impossible to develop. In the case of nitride film, as is well-known, the color variation is limited to golden colors. Moreover, the uniformity and reproducibility of color development are not good.

The anode oxidation process takes advantage of the phenomenon that an oxide film is formed on the titanium surface, when a DC current is passed at a constant current, using metallic titanium as the anode in an electrolytic cell. As a certain film tickness is reached, current does not flow, and the voltage and the film thickness are proportional to each other. Therefore, the tones are copious, reproducibility of each color is good, and the process is easy to control, but the black color is not obtainable. Besides, it has a fatal defect that its applicable configuration is limited to plate or lump shape. Further, since the tone is altered by fingerprints, and the film produced by this process has poor wear resistance, the film's durability quality is low.

The chemical oxidation process is a method for developing colors by harnessing the action of light interference, with an oxide film formed by subjecting metallic titanium to a boiling treatment in an inorganic acid. This method is simple, but its efficiency is low, taking long time in film growth. It provides only small color variations.

It is therefore an object of this invention to provide a color development method of metallic titanium which enables colored titanium rich in color variation, irrespective of the material configuration.

Another object of this invention is to provide a color development method of metallic titanium which enables manufacture of black titanium with low brightness, also black titanium with high close film adherence and other colored titanium.

Still another object of this invention is to provide black titanium and other colored titanium produced by any of these methods which are high in quality but low in price.

DISCLOSURE OF THE INVENTION

A color development method of metallic titanium of this invention comprises treating the surface of metallic titanium with an alkaline solution. Another color development method of metalic titanium of this invention comprises forming a titanium nitride film on the surface of metallic titanium by subjecting it to a nitration treatment, and thereafter subjecting the metallic titanium to a oxidation treatment.

Whichever method is able to relatively simply produce colored titanium rich in color variations, irrespective of material configuration. In addition, the former method is capable of manufacture of black titanium which is not only low in brightness but also high in close film adherence and titanium in other colors.

The colored titanium of this invention is produced by the former or the latter method. The former method provides a means of producing colored titanium rich in tone and high in close film adherence simply at low tempratures near the normal temperature, irrespective of material configuration. Accordingly, the colored titanium produced by the former method has tones hitherto unavailable, to the benefit of high merchandize value and low price. The latter method provides a means of simply producing colored titanium rich is tone, irrespective of material configuration. Accordingly, the colored titanium produced by this method also has high merchandize value at low price.

Further, the black titanium of this invention is produced by the latter method. The latter method provides a means of producing black titanium low in brightness and high in close film adherence simply at a low temperature near the normal temperature, irrespective of material configuration. Accordingly, the black titanium of this invention is high in quality and low in price.

In the following, respective methods are described in detail, designating the former first color development method, and the latter second color development method.

First Color Development Method

The first color development method treats the surface of metallic titanium with an alkali solution. As the alkali solution, aqueous alkaline metal solutions of KOH, NaOH and LiOH etc. may be used singly or in mixture.

In the first color development method, the tone varies from gray to brown, black and sky blue and so on, with rising treating temperatures, within the treatment temperature range from 40° C. to 200° C., for example. This may be interpreted as follows: As the surface of metallic titanium is treated with an alkali solution, a fine corrugation which facilitates absorption of light is formed on the titanium surface, and this corrugated configuration undergoes changes due to varying tempertures, resulting in development of various colors. Then as the reaction further proceeds, amorphous titanium compounds grow in its surface layer, producing coloraton of sky blue.

The fine corrugation formed on the metallic titanium surface produced by the alkali solution treatment has turned out to be due to a coating of fibrous structure which has grown coating the metal surface, as observed by SEM. This coating is believed to be formed by a mechanism that the metallic titanium dissolves in the alkali, then depositing on its surface, and also forming oxides of alkali titanium, bringing about a porous construction with intricate structure like fiber's. This coating not only has a surface corrugation which is favorable for color development, but excels in close adherence over the conventional coating. This is also believed to result from the fibrous construction of the coating.

Further, as the metallic titanium having black color developed on its surface by the alkali solution treatment is subjected to nitriding treatment, the brightness of the black color further diminishes. This is believed to have resulted from the fact that the coating of the fibrous construction on the surface is altered to brown titanium nitride, and that because of its fine structure, the blackening has proceeded. When the metallic titanium having sky blue color developed on its surface by the alkali solution treatment is subjected to nitriding treatment, this sky blue turns to grayish white.

As hereinabove described, by treating metallic titanium with an alkali solution, and thereafter subjecting it to nitriding treatment, as required, it is possible to produce a black titanaium having low brightness and high close film adherence simply by an operation run at a low temperature near the normal temperature. Besides, it is also possible to produce a coating rich in tones and high in close film adherence simply by an operation run at a low temperature near the normal temperature. These coatings, because of their fine fibrous construction, are excellent in wear resistance etc. and have high durability qauality. Furthermore, because the tones may be controlled by temperature, the controllability and reproducibility are also excellent in coating formation.

In the first color development method, the metallic titanium used may be either pure titanium or any titanium alloys. It may be in any form, either plate-shaped, lumpy, powdery or the like. The powder used is not limited to amorphous one, but spherical powder formed by the gas atomizing process etc. or one turned scaly by treating it in a ball mill is usable.

Second Color Development Method

The second color development method comprises nitriding metallic titanium to form a titanium nitride film on its surface, and thereafter oxidizing the metallic titanium. The nitriding and oxidizing treatments are normally performed in gas phase.

In the second color development method, the formation of titanium nitride film on the surface of metallic titanium by the nitriding treatment turns the metallic titanium golden in color. This metallic titanium may be tinted in a variety of colors by oxidizing this metallic titanium with the holding temperature and time varied in this process.

FIG. 1 is a graph illustrating the effect of the holding time and temperature in the oxidation treatment on the color variation, when performing the nitriding (forming titanium nitride coating)—oxidation treatments. The titanium nitride film existing on the surface of the nitrided titanium before undergoing the oxidation treatment was set to 0.1 $\mu$m.

As the holding time and temperature at the oxidation process conducted after formation of the titanium nitride film are varied along the curves from A to B, C, D and E, the golden metallic titanium which has been nitrided produces different colors—brownish, deep bluish, greeny and pinky—in correspondence thereto. The region below the curve A represents a golden region where no color change occurs, while in the region above the curve E, no color change occurs, remaining ochrey (lemony), even if the holding time and temperature are altered.

In this way, the second color development method enables tinting the material in gas phase in pinky or yellowy-greenish color which has been impossible to do in the gas phase process by conducting a nitriding treatment for forming titanium nitride on the material followed by an oxidation treatment, irrespective of its configuration. This is believed to result from the fact that a titanium oxide layer is formed on a titanium nitride layer, such a compounded thin film differing in irregularity from the one produced by the nitriding or oxidation process only, making available tones which have heretofore been impossible to have in developing colors.

It is to note that an attempt to make the colorations by oxidizing titanium nitride powder formed by nitriding the whole of titanium powder appears in a journal Pigment Vol. 32, No. 1, pp. 16–20, which reports that the tones obtained are turbid in brownish or grayish colors and so have only low merchandize value; no lucid tones as produced by this invention have not been obtained. The reason is because the tones undergo changes depending on the surface condition of the substrate titanium and the film thickness of the titanium nitride layer. Normally, flat and smooth substrate surface produces lustrous and lucid tone, but corrugation induces turbid colors.

The metallic titanium used in the second color development process may be either pure titanium or any titanium alloys. It may have whichever form such as plate-shaped, lumpy or powdery. The powder used will not be limited to amorphous one, but spherical powder produced by the gas atomizing process etc. or scaly one produced from it by use of a ball mill etc. and other powdery products are usable.

BEST MODES FOR CARRYING OUT THE INVENTION

Figure 1:
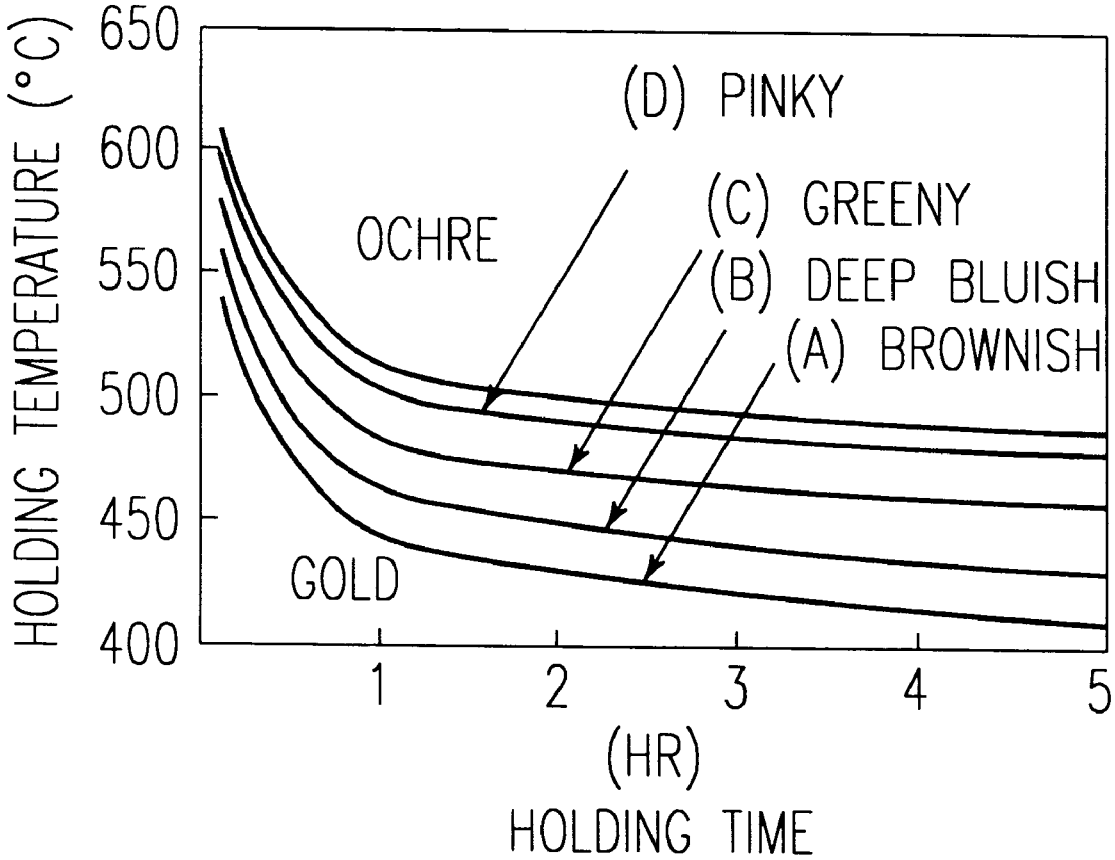
FIG. 1 is a graph illustrating the effect of the oxidation process conditions in the present invention (second color development method) on the color variation; and, FIG. 2 is a graph comparing this invention (second color development method) with the conventional method in terms of color variations.

In the following, a preferable mode for carrying out the present invention will be described in the order of the first and the second color-development methods:

First Color Development Method

A first step comprises dipping metallic titanium into an alkali solution inside a reactor container, and then heating the inside of the container to a specified temperatre by means of an outside heater etc.

The alkali solution used includes, for example, aqueous solutions of alkaline metals containing KOH, NaOH and LiOH etc. and aqueous ammonia solution and so on used singly or in mixed solutions.

The concentration of the alkali solution is not particularly limited, but low concentration requires longer reaction time, while higher concentration causes rapid reaction, making control difficult. Desirable ranges are 1–10 mol/lt for the aqueous solutions of alkali metals containing KOH, NaOH and LiOH etc., and 1–1.5 mol/lt for aqueous ammonia solution.

With regard to the proportion of alkali solution and metallic titanium, there is no restriction; it is only proper that the metallic titanium may be dipped in the solution.

From the viewpoint that the reaction chamber should be resistant to alkalis, it should desirably be made of stainless steel or teflon. It should desirably be provided with a stirrer for keeping constant the temperature in the chamber. Further, it should desirably be a closed container for prevention of loss of water content due to steam splashing during the heating.

The heating temperature is a factor having the largest influence on the color development of metallic titanium. Low heating temperature requires long reaction time, whereas high temperature accelerates the reaction, making it difficult to control it. For this reason in the aspect of operation, the heating temperature should desirably be in the range of 40–200° C. Within this temperature range, as the temperature is raised, the tone changes from gray to black, sky blue and so on in the order mentioned. Accordingly, by choosing the heating temperature corresponding to the desired color and maintainning it, that color may be developed. If black color is particularly desired to have, a temperature range of 60–90° C. is desirable.

The reason why the color development is governed by the heating temperature is because it has an effect on the solubility of titanium and the subsequent reaction rate. The reaction causes the formation of the coating, with varying tones according to the configuration and thickness of the coating.

The heating time, likewise the heating temperature, influences the formation of coating. When the heating time is varied at a constant temperature, the formation of coating is insufficient in short time, producing heterogeneous film, and thereafter the tone greatly changes until it becomes homogeneous. As the heating time is further prolonged, slight changes in tone are observed. From this viewpoint, the heating time should desirably be set within a range of 2–5 hr. Thus up to 2 hr heating time, the coating is formed inadequately, thus tending to be heterogeneous, and moreover tone change is pronounced, giving rise to difficulty in color control. After an elapse of 2 hr, the tone change is gradual, permitting facile color control. If it exceeds 5 hr, the tone will change no more.

As the first step is ended, the alkali solution is removed from the metallic titanium which has undergone the treatment with the alkaki solution, followed by its drying as the second step. The method of alkali removal includes filtration, ultrasonic cleaning and decantation and so forth. For prevention of oxidation of metallic titanium, the drying should preferably be performed at a low temperature from 100–150° C., it being desirable to continue it for more than 5 hr for complete removal of water content.

If the nitriding process is desired to perform, it should be done as a third step. In this process, metallic titanium should desirably be held at 800–1200° C. for 1–5 hr in a nitrogen gas atmosphere. Low process temperature fails to advance the nitration, while high temperature causes too rapid reaction, making control difficult. Particularly desirable process temperature should be 1000–1100° C. With regard to the process time, short time fails to advance the nitration, while long time deteriorates the productiviy.

Second Color Development Method

As a first step, nitration process is performed. This nitration is normally conducted in gas phase. Spongy, plate-shaped or lumpy material may be treated in an electric or other atmospheric furnaces, but powder, particularly very fine powder, permits employment of a heating system which affords employment of a vibratory fluidized bed, thereby making the inside bed temperature uniform.

In the nitration process, the thickness of the titanium nitride film is important. Thin film increases the influence of the subsequently formed oxide film, resulting in monotonous colors, while too thick films produce, turbid tones. From this viewpoint, the titanium nitride should desirably be 0.05–2 $\mu$m, particularly 0.1–1 $\mu$m thick.

As a practical condition of nitration, the temperature raising rate should desirably be 100° C./hr or less, particularly 20–50° C./hr. This is because too high a temperature raising rate will cause grain growth, forming agglomerated crystal grains; conversely, too low a temperature raising rate will result in taking long reaction time.

Desirable holding temperature should be from 800–1200° C. Too low a temperature will require long time for the film formation, while too high a temperature will make film thickness control difficult, causing it to be too thick, and resulting in turbid color in the subsequent oxidation. The tone is basically golden, but it turns from dark to bright golden in the temperature range from 800–1200° C. The holding time should desirably be about 1 hr, with a view to having uniform coloration.

Prior to the nitration process, it is desired to perform such pretreatments as defatting and acid etching, and further grinding etc. for plate-shaped material.

After the nitration process, an oxidation process is performed as a second step. Spongy, plate-shaped and lumpy material may be treated in an electric or other atmospheric furnaces, while powder, particularly fine powder, permits employment of heating system which equalizes the inside-bed temperature using a vibratory fluidized bed.

In the oxidation process, the holding time and temperature are important. The color variation is determined by how they are selected (refer to FIG. 1). As the oxygen concentration in the atmosphere is altered, the relationship between tone vs. holding time and temperature undergoes changes, but the range of color variation remains basically unaltered, provided that the holding time should preferably be adjusted within a range of 0.5–10 hr, and the holding temperature within 350–600° C. The reason is because such conditions are conducive to ease of film thickness control and formation of uniform coloration.

The temperature raising rate in the oxidation process should desirably be 100° C./hr or less, particularly 20–50° C./hr. Too rapid a temperature raise will cause ignition or combustion, while too slow a rate will demand long reaction time.

In the following, embodiments and comparative examples of this invention will be described in connection with the first and the second color development methods in the order mentioned:

First Color Development Method

EXAMPLE 1-1

An aqueous solution of KOH was prepared by putting 112 g KOH and 500 g water in a reactor made of SUS with a 1 liter capacity, followed by stirring. A sheet of titanium plate (20 mm×20 mm×1 mm thick) was put into this solution, to undergo the reaction at 100° C. for 20 hr. Upon ending the reaction, the aqueous KOH solution was washed off the plate with water, and it was dried at 100° C. for 20 hr. The surface of the titanium plate obtained appeared black in color. When this titanium plate was held at 1000° C. for 1 hr in a nitrogen current, a blacker titanium plate was obtained.

EXAMPLE 1-2

An aqueous solution of NaOH was prepared by putting 120 g NaOH and 500 g water in a reactor made of SUS with a 1 liter capacity, followed by stirring. Fifty grams of spongy titanium (approx. 10 mm mean particle diameter) was put into this solution, to undergo the reaction at 80° C. for 4 hr. Upon ending the reaction, the aqueous NaOH solution was washed off the product with water, and it was dried at 100° C. for 20 hr. The titanium powder obtained appeared black in color. When this titanium powder was held at 1100° C. for 2 hr in a nitrogen current, a blacker titanium powder was obtained.

EXAMPLE 1-3

Ten mol/liter aqueous solution of ammonia and 50 g of titanium powder (spherical, 70 μm mean particle diameter) were put in a reactor made of SUS with a 1 liter capacity, to undergo the reaction at 150° C. for 5 hr. Upon ending the reaction, the aqueous ammonia solution was washed off the powder with water, and it was dried at 100° C. for 20 hr. The titanium powder obtained appeared black in color. When this titanium powder was held at 900° C. for 5 hr in a nitrogen current, a blacker titanium powder was obtained.

EXAMPLE 1-4

An aqueous solution of KOH was prepared by putting 112 g KOH and 500 g water in a reactor made of SUS with a 1 liter capacity, followed by stirring. A sheet of titanium plate (20 mm×20 mm×1 mm thick) was put into this solution, to undergo the reaction at 40° C. for 5 hr. Upon ending the reaction, the aqueous KOH solution was washed off the plate with water, and it was dried at 100° C. for 20 hr. The surface of the titanium plate obtained appeared gray in color. When this titanium plate was held at 1000° C. for 1 hr in a nitrogen current, a brown titanium plate was obtained.

EXAMPLE 1-5

An aqueous solution of NaOH was prepared by putting 120 g KOH and 500 g water in a reactor made of SUS with a 1 liter capacity, followed by stirring. Fifty grams of spongy titanium (approx. 10 mm mean particle diameter) was put into this solution, to undergo the reaction at 220° C. for 3 hr. Upon ending the reaction, the aqueous NaOH solution was washed off the product with water, and it was dried at 100° C. for 20 hr. The titanium powder obtained appeared sky blue in color. When this titanium powder was held at 1100° C. for 2 hr in a nitrogen current, a grayish white titanium powder was obtained.

EXAMPLE 1-6

Zero point one mol/liter aqueous solution of ammonia and 50 g of titanium powder (spherical, 70 μm mean particle diameter) were put in a reactor made of SUS with a 1 liter capacity, to undergo the reaction at 150° C. for 2 hr. Upon ending the reaction, the aqueous ammonia solution was washed off the powder with water, and it was dried at 100° C. for 20 hr. The titanium powder obtained appeared gray in color. When this titanium powder was held at 900° C. for 5 hr in a nitrogen current, a light blue titanium powder was obtained.

COMPARATIVE EXAMPLE 1-1

An aqueous solution of KOH was prepared by putting 112 g KOH and 500 g water in a reactor made of SUS with a 1 liter capacity, followed by stirring. Fifty grams of titanium powder (spherical, 70 μm mean particle diameter) was put into this solution, to undergo the reaction at 250° C. for 8 hr. Upon ending the reaction, the aqueous KOH solution was washed off the powder with water, and it was dried at 100° C. for 20 hr. The titanium powder underwent no change before and after the reaction.

COMPARATIVE EXAMPLE 1-2

An aqueous solution of KOH was prepared by putting 112 g KOH and 500 g water in a reactor made of SUS with a 1 liter capacity, followed by stirring. Fifty grams of titanium powder (spherical, 70 μm mean particle diameter) were put into this solution, to undergo the reaction at 250° C. for 2 hr. Upon ending the reaction, the aqueous KOH solution was washed off the powder with water, and it was dried at 100° C. for 20 hr. The titanium powder obtained was white in color, witnessing the formation of titanium dioxide.

Examples 1-1 to 1-3 concern black titanium. In order to evaluate the brightness of the black titanium in Examples 1-1 to 1-3, an examination was made with use of a spectrophotometric colorimeter (Minolta CM-3500d). The results are as shown in Table 1. Favorable black was recognized at L*<30. In Examples 1-1 to 1-3, mere alkali treatment gave L* at 30 or less, thus producing low brightness black titanium. Additional nitriding treatment reduced L* to about 10.

Examples 1-4 to 1-6 concerns colored titanium. In these examples, browny, grayish and bluey tone colored titanium were obtained. The results are shown in TABLE 2.

Results of Comparative Examples 1-1 and 1-2 are shown in TABLE 3. In Comparative Example 1-1, because of low reaction temperature, the reaction did not proceed. In Comparative Example 1-2, due to too high a reaction temperature, the metallic titanium underwent the reaction in its molten state, therefore forming titanium dioxide.

TABLE 1

| Alkali treatment | | Nitriding treatment | |
|---|---|---|---|
| Alkali | Concentration | Temperature | Time |
| Brightness | Examples 1-1–1-3 | | |

L* Represents brightness ranging from brack (0) to white (100)

TABLE 2

| Alkali treatment | | Nitriding treatment | | |
|---|---|---|---|---|
| Alkali | Concentration | Temperature | Time | Tone |
| Example 1-4 | Deep gray | Brown | | |
| Example 1-5 | Sky blue | Grayish white | | |
| Example 1-6 | Ammonia | Light gray | Light blue | |

TABLE 3

| Alkali treatment | | | | |
|---|---|---|---|---|
| Alkali | Concentration | Temperature | Time | Tone |
| Comparative Example 1-1 | | No change | | |

COMPARATIVE EXAMPLE 1-2

White (titanium dioxide formed)

Second Color Development Method

EXAMPLE 2-1

Three hundred grams of spherical powder (1–5 mm particle diameter) of sponge titanium was defatted by use of 5 mol/liter aqueous solution of KOH, followed by thorough cleaning, to prepare material titanium. This titanium was set in an electric furnace, heated up to 110° C. at a rate of 70° C./hr in a nitrogen atmosphere, and held at this temperature for 2 hr. After natural cooling to the room temperature, it was taken out, and made out to be colored in gold. The titanium nitride film was found to have 1 μm thickness. Then the gold colored titanium was set in the electric furnace, heated up to 500° C. at a rate of 50° C./hr in atmosphere, and held at this temperature for 1 hr. After natural cooling down to the room temperature, it was taken out, and made out to be colored in light green.

COMPARATIVE EXAMPLE 2-1

As the nitration process conditions were modified to raising the temperature up to 1300° C. at a rate of 70° C./hr in a nitrogen atmosphere, and holding this temperature for 2 hr in Example 2-1, the titanium nitride film was found to have a 3.5 μm thickness and reddish gold tone.

The tone after the oxidation process was basically bluey green, but somewhat turbid.

COMPARATIVE EXAMPLE 2-2

As the nitration process conditions were modified to raising the temperature up to 700° C. at a rate of 70° C./hr in a nitrogen atmosphere, and holding this temperature for 3 hr, the titanium nitride film was found to have a 0.01 μm thickness and gray tone. The tone after the oxidation process was bluey, barely manifesting the effect of the nitration process.

EXAMPLES 2-2–2-13

Five hundred grams of scaly powder (45 μm particle diameter, 1 μm thick) of titanium was set in a vibratorily fluidized bed column, heated up to 900° C. at a rate of 40° C./hr in a nitrogen current, and held at this temperatre for 1 hr. The powder thus obtained developed gold color. The titanium nitride film was found to have a 0.1 μm thickess. Next argon gas mixed with air was introduced, and the gold tinted powder was fluidized under vibraton, heated up to 350–500° C. at a rate of 40° C./hr, and held at this temperture for 0.5–5.0 hr. After cooling, the powder was taken out, and its tone was measured with a spectrophotometric colorimeter (Minolta CM-3500d).

EXAMPLES 2-14 and 2-15

Five hundred grams of spherical powder (45 μm or less particle diameter) of titanium was put in a crucible, and this crucible was set in a furnace having a nitrogen atmosphere, heated up to 1000° C. at a rate of 50° C./hr in a nitrogen current, and held there for 1 hr. The powder thus obtained developed gold color. The titanium nitride film was found to have a 0.5 μm thickess. Next it was heated up to 380–500° C. at a rate of 40° C./hr, and held at this temperture for 3 hr in an atmosheric furnace. After cooling, the powder was taken out, and its tone was measured with a spectrophotometric colorimeter (Minolta CM-3500d).

EXAMPLES 2-16–2-21

Five hundred grams of crushed powder (45–250 μm particle diameter, amorphous) of titanium was put in an alumina crucible, and this crucible was set in a furnace having a nitrogen atmosphere, heated up to 1000° C. at a rate of 50° C./hr in a nitrogen current, and held there for 1 hr. The powder thus obtained developed gold color. The titanium nitride film was found to have a 0.5 μm thickess. Next it was heated up to 380–500° C. at a rate of 40° C./hr, and held at this temperture for 3 hr in an atmospheric furnace. After cooling, the powder was taken out, and its tone was measured with a spectrophotometric colorimeter (Minolta CM-3500d).

EXAMPLES 2-22–2-27

A 500 g titanium plate (30 mm×50 mm×1 mm) was put in an alumina crucible, and this crucible was set in a furnace having a nitrogen atmosphere, heated up to 1200° C. at a rate of 100° C./hr in a nitrogen current, and held there for 1 hr. The plate thus obtained developed gold color. The titanium nitride film was found to have a 2.0 μm thickess. Next it was heated up to 500–580° C. at a rate of 50° C./hr, and held at this temperture for 1.0–4.0 hr in an atmospheric furnace. After cooling, the plate was taken out, and its tone was measured with a spectrophotometric colorimeter (Minolta CM-3500d).

EXAMPLES 2-28 and 2-29

Five hundred grams of scaly powder (70 μm particle diameter, 5 μm thick) of titanium was put in a zirconia crucible, and this crucible was set in a furnace having a nitrogen atmosphere, heated up to 1000° C. at a rate of 100° C./hr in a nitrogen current, and held there for 2 hr. The powder thus obtained developed gold color. The titanium nitride film was found to have a 1 μm thickess. Next the powder obtained was continuously introduced into a rotary kiln at a rate of 5 g/min, and was held at 550° C. for 1 and 0.2 hr respectively, and was then taken out. The tone of the powder taken out was measured with a spectrophotometric colorimeter (Minolta CM-3500d).

COMPARATIVE EXAMPLES 2-3–2-8

For comparison, 500 g of scaly titanium powder (45 μm particle diameter, 1 μm thick) was set in an 80 mm ID vibratory fluidized bed column, heated up to 800–1100° C. at a rate of 40° C./hr in a nitrogen current, and held there for 1.0–2.0 hr. After cooling, the powder was taken out, and its tone was measured using a spectrophotometric colorimeter (Minolta CM-3500d). The titanium nitride was found to have a 0.05–1 μm thickness.

COMPARATIVE EXAMPLES 2-9–2-24

Further the same scaly titanium powder was set in the same column, and brought into a state of being fluidized with use of argon gas mixed with air. The temperature inside the column was then raised up to 320–510° C. at a rate of 40° C./hr, and this temperature was maintained for 1.0–20 hr. After cooling, the powder was taken out, and its tone was measured using a spectrophotometric colorimeter (Minolta CM-3500d).

Results of measurement of the tone by a spectrophotometric colorimeter in Examples 2-2–2-27 are exhibited in TABLE 4, together with the conditions of the oxidation process. Measurement results obtained in Comparative Examples 2-3–2-24 are shown in TABLE 5. The process conditions given in TABLE 5 include nitration conditions in Comparative Examples 2-3–2-8 and oxidation conditions in Comparative Examples 2-9–2-24. In both tables, L* represents the white and black brightness (0 is assigned to black, and 100 to white), a* represents the concentration of red and green (+ is assigned to red, and – to green), and b* that of yellow and blue (+ yellow and = blue).

TABLE 4

| Holding temperature | Holding time | Examples 2-1–2-29 |
|---|---|---|

TABLE 5

| Holding temperature | Holding time |
|---|---|
| Comparative Examples 2-3–2-24 | |

Figure 2:
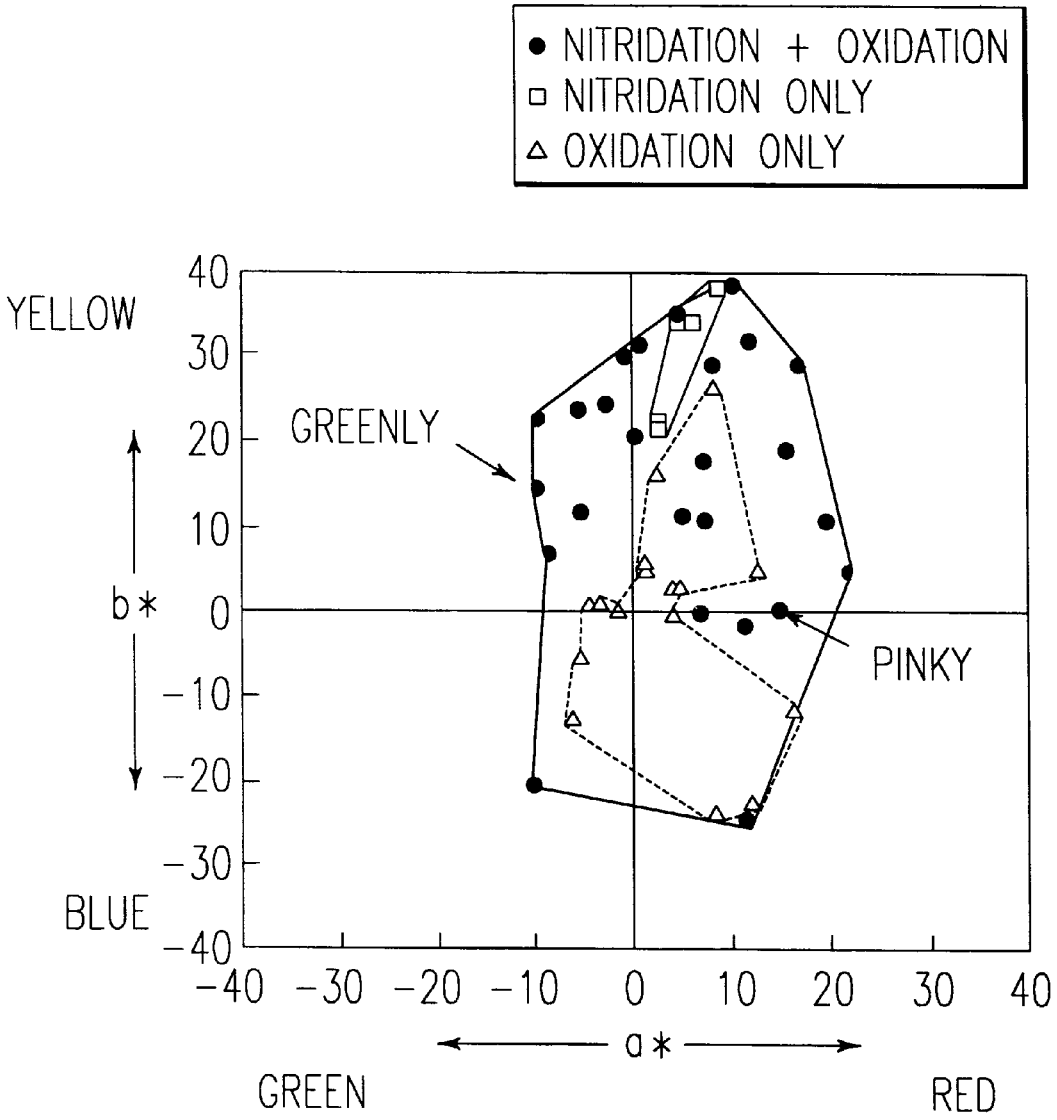

FIG. 2 Displays major examination results on a a*-b* graph. When the nitriding only is performed (Comparative Examples 2-3–2-8), the tone is limited to golden. In the case of oxidation only (Comarative Examples 2-9–2-24), wide color variations are obtained in bluey and browny ranges, but pinky and greeny colors are not obtainable. When oxidation is performed after nitriding (Examples 2-2–2-29), wide ranges of tone are obtained, embracing pinky and greeny colors. Moreover, because the treatment is made in gas phase, coloration is practical in disregard of the material configuration.

COMPARATIVE EXAMPLE 2-25

When titanium nitride powder (10 $\mu$m particle diameter) was heated up to 480° C. at a rate of 50° C./hr in atmosphere, and held at this temperture for 1–5 hr, the tone turned gray, but such a turbid colored titanium powder has only limited uses and so almost no merchandize value.

INDUSTRIAL UTILITY

As is evident from the foregoing description, the color development method of metallic titanium of this invention enables wide ranges of colors from low brightness black to various tones to be simply developed, in disregard of the material configuration, by treatment with alkali solution at relatively low temperatures. Since the color is governed by the treatment temperature, controllability and reproducibility are high, and further excellent close coating adherence is attainable. Accordingly, it is useful for expanding the uses of the black and colored titanium, and so forth.

Besides, by the two step process consisting of formation of titanium nitride film by nitration and subsequent oxidation, it enables even tones which have been untintable by the conventional gas phase technique to be tinted in gas phase in disregard of the material configuration. Accordingly, it is useful for expanding the uses of colored titanium, and so forth.

Furthermore, the black and colored titanium of this invention has high merchandize value with recondite tones which have hitherto been unavailable, and yet is low-priced, because of low manufacturing cost. Accordingly, it is useful for expanding the uses of the black and colored titanium, and so forth.

What is claimed is:

1. A method of developing color on metallic titanium, which comprises:

treating the surface of metallic titanium with an alkali solution to finish treat the titanium; and then nitriding the finish treated titanium.

2. The method of claim 1, wherein, in the process of treating titanium with an alkali solution, the treating temperature is set to within the range of 40–200° C., thereby developing color on the titanium surface as a function of a specific preset processing temperature.

3. The method of claim 1, wherein the treating temperature in the nitriding process is 800–1200° C.

4. A method of developing color on metallic titanium, which comprises:

heating metallic titanium in plate, mass or powder form under a nitrogen atmosphere, thereby forming a titanium nitride film on the surface of the titanium; and heating the nitrided titanium under an oxygen gas atmosphere in order to oxidize the nitride film.

5. The method of claim 4, wherein the nitriding and subsequent oxidation processes are conducted in a gas phase environment.

6. The method of claim 4, wherein the titanium nitride film formed on the titanium by the nitriding process ranges in thickness from 0.05–2 $\mu$m.

7. The method of claim 5, wherein the titanium nitride film formed on the titanium by the nitriding process ranges in thickness from 0.05–2 $\mu$m.

8. The method of claim 4, wherein, in the oxidation process, the treatment temperature and time are set within the range of 350–600° C. and 5–10 hour respectively, thereby developing color on the titanium surface as a function of the specific preset processing temperature and time.

9. The method of claim 5, wherein, in the oxidation process, the treatment temperature and time are set within the range of 350–600° C. and 5–10 hour respectively, thereby developing color on the titanium surface as a function of the specific preset processing temperature and time.

10. The method of claim 6, wherein, in the oxidation process, the treatment temperature and time are set within the range of 350–600° C. and 5–10 hour respectively, thereby developing color on the titanium surface as a function of the specific preset processing temperature and time.

11. The method of claim 7, wherein, in the oxidation process, the treatment temperature and time are set within the range of 350–600° C. and 5–10 hour respectively, thereby developing color on the titanium surface as a function of the specific preset processing temperature and time.

* * * * *